United States Patent [19]

Weldon

[11] Patent Number: 4,571,468

[45] Date of Patent: Feb. 18, 1986

[54] INDUCTIVE STORE OPENING SWITCH

[75] Inventor: William F. Weldon, Austin, Tex.

[73] Assignee: University of Texas System, Austin, Tex.

[21] Appl. No.: 399,017

[22] Filed: Jul. 16, 1982

[51] Int. Cl.[4] ..... H01H 39/00

[52] U.S. Cl. ..... 200/61.08; 337/290

[58] Field of Search ..... 200/61.08; 337/290, 337/295

[56] References Cited

U.S. PATENT DOCUMENTS

| | | | |
|---|---|---|---|
| 2,892,062 | 6/1959 | Bruckner et al. | 337/290 |
| 3,819,890 | 6/1974 | Kozorezou et al. | 200/61.08 |
| 3,848,100 | 11/1974 | Kozorezou et al. | 200/61.08 |
| 3,932,717 | 1/1976 | Dike et al. | 200/61.08 |
| 4,174,471 | 11/1979 | Ford et al. | 200/61.08 |
| 4,296,285 | 10/1981 | Lang et al. | 200/61.08 |
| 4,345,127 | 8/1982 | Niemeyer | 200/61.08 X |
| 4,490,707 | 12/1984 | O'Leary | 200/61.08 |

OTHER PUBLICATIONS

"Two Stage Opening Switch Techniques for Generation of High Inductive Voltages" D. Conte, R. D. Ford, W. H. Lupton and I. M. Vitkovitsky; IEEE Cat. No. 77CH1267-4-NPS (1977) p. 1066.

*Primary Examiner*—J. R. Scott

*Attorney, Agent, or Firm*—Arnold, White & Durkee

[57] ABSTRACT

The inductive store opening switch includes a cartridge casing comprising a length of metal tubing, for disposition between a pair of electrical buss bar conductors and in contact with both so as to establish a path for electrical current therethrough. The tubular casing, having inner and outer surfaces, is scored on its outer surface to establish a rupturing point. The scoring on the outer surface may constitute many different geometric forms. A solid body of inert material is insertable within the casing and disposed adjacent the rupturing point of the casing. A propellant cartridge carrying a combustible material, such as gun powder, is disposed within the casing opposite the inserted body so as to define a cavity volume within the casing proximate the rupturing point of the casing. The cartridge further includes structure for igniting the material. The oxidation-gas products produced by ignition of the material in the propellant cartridge expand into the volume defined within the casing and cause rupturing of the casing along the scoring, thereby breaking the electrical current path established by the casing. Reinforcement members extending circumferentially of the casing on opposite sides of the scoring, may be used to control the extent of rupturing of the casing and control the gap width between casing halves. Alternatively, the casing may be ruptured by introduction of a pressurized fluid by the dumping of fluid from a high pressure accumulator into the cavity volume using a fast-acting valve.

11 Claims, 9 Drawing Figures

INDUCTIVE STORE OPENING SWITCH

BACKGROUND OF THE INVENTION

The present invention relates to an opening switch for use in inductive energy storage systems. More particularly, the present invention relates to an opening switch for providing controlled transfer of energy from an inductive energy stored source.

Inductive energy storage systems include a primary energy source, such as a homopolar generator, an inductor, and a primary opening switch element. Heretofore, inductive energy storage systems have been utilized as high voltage pulse generators and, more recently, as the power source in railgun accelerators.

In high voltage pulse generators of the inductive energy store type, the opening switch element has been an explosively actuated device. Since the objective of such systems is to generate high voltage, the opening switch devices must operate to transfer energy in microseconds, and are so designed.

The accelerating force in a parallel-rail railgun accelerator is obtained by the interaction of the current in the driven armature with the magnetic field produced by the current in the rails, with the armature and the rails being connected in series. Therefore, current control, rather than voltage generation, is of importance in railgun operation. Opening switch devices used in high voltage pulse generators are inappropriate for railgun use.

SUMMARY OF THE INVENTION

The present invention provides an inductive store opening switch for use in the controlled transfer of energy from an inductive energy stored source. In accordance with the present invention, the switch utilizes a hollow casing member which is ruptured to provide switch opening action. The casing is scored on its outer surface to facilitate rupturing in a specific location and in as desired manner, with rupturing of the casing being achieved by fluid pressure established within the casing.

In accordance with the present invention, rupturing of the casing may be by gas pressure produced by the oxidationgas products from ignition of a combustible material, such as gun powder. Alternatively, rupturing may be by introducing pressurized fluid from an external source into the casing.

The objective of the switch device of the present invention is the controlled rupturing of the casing to promote a smooth, sustained transfer of energy (i.e., transfer of energy over at least a millisecond time duration). This is in contrast to an explosively-actuated (i.e., spontaneous detonation) switch, which begins interrupting current in a matter of only tens or hundreds of microseconds.

The parameters defining switch opening characteristics include in addition to quantity and burning rate of the combustible material charge, casing wall thickness, and depth of score, the scoring pattern and the gas pressure rise as a function of time. The scoring pattern, though susceptible to many different configurations, preferably comprises score lines having acute angle bottoms. Fluid pressure rise is suitably controlled in accordance with the present invention by insertion of a body within the casing opposite either a cartridge carrying a charge of combustible material or a fluid jet nozzle that serves to introduce high pressure fluid.

BRIEF DESCRIPTION OF THE DRAWINGS

A written description setting forth the best mode presently known for carrying out the present invention, and of the manner of implementing and using it, is provided by the following detailed description of preferred embodiments which are illustrated in the attached drawings wherein.

DETAILED DESCRIPTION OF PREFERRED EMBODIMENTS

Figure 1:
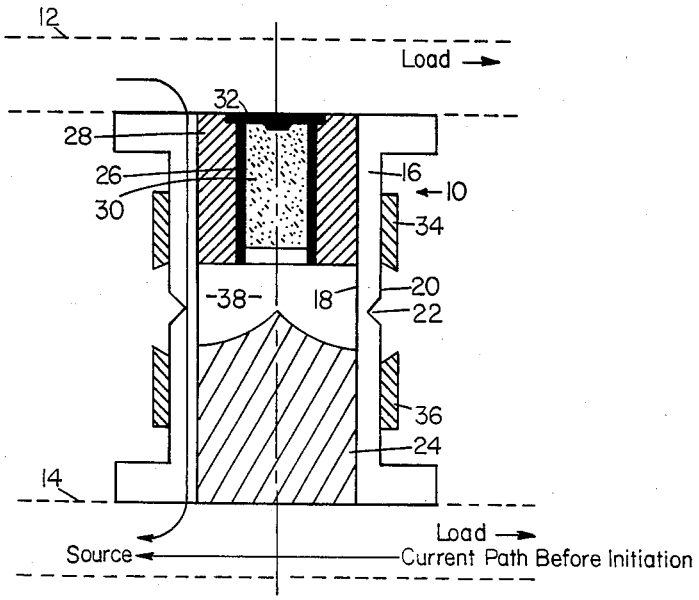
FIG. 1 is a section view of one embodiment of an inductive store opening switch in accordance with the present invention, before opening.
Figure 2:
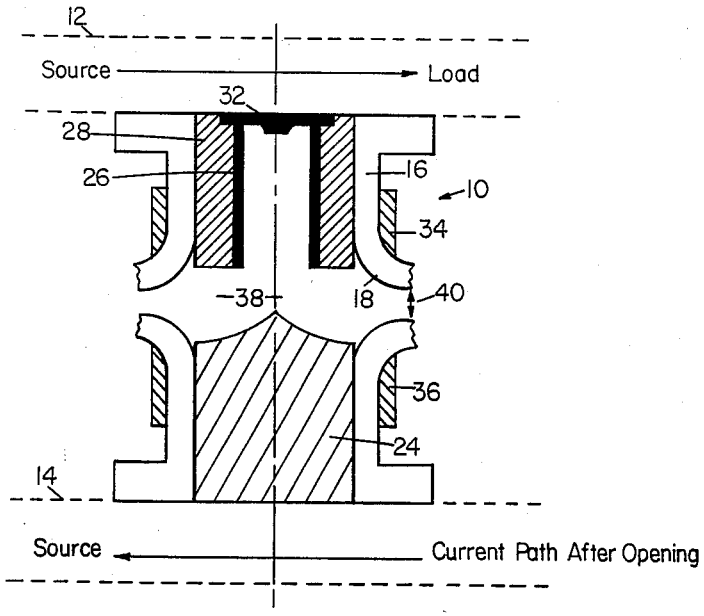
FIG. 2 is a section view of the switch in FIG. 1, after opening.

Referring now to FIGS. 1 and 2, there is shown in section view an inductive store opening switch 10 in accordance with the present invention. The switch 10 is shown in FIGS. 1 and 2 in before and after opening illustrations, respectively.

Switch 10 is shown installed between electrical conductors in the form of buss bars 12 and 14, which carry electrical current between a source and a load. The source may be an inductive energy store charged by a homopolar generator. The load may, for example, be a railgun. Switch 10 serves to initially make a connection between electrical conductors 12 and 14, and provide a path for current flow therebetween. Switch 10 further serves upon actuation to break the electrical connection between conductors 12 and 14.

Switch 10 includes hollow casing 16 for disposition between electrical conductors 12 and 14, so as to be in contact with both and thereby establish a path for electrical conduction therebetween. Casing 16 may suitably be a flanged aluminum tube having a wall thickness of about 1 cm. Casing 16 being hollow has inner and outer surfaces 18, 20 with the outer surface 20 being provided with scoring to establish a rupturing location thereon. In the embodiment shown in FIG. 1, the scoring comprises a single circumferential groove 22 intermediate the ends of casing 16. The depth of groove 22 is suitably about 0.5 cm.

A body of material 24 is inserted within casing 16 and disposed adjacent the rupturing location. A second body including a propellant cartridge 26 is disposed within casing 16 adjacent the rupturing location and opposite the inserted body 24. Cartridge 26 is mounted within casing 16 by a sleeve 28. Cartridge 26 carries an ignitable material 30 for producing expanding oxidation-gas products. Suitably, gun powder is used. Cartridge 26 further includes means for igniting material 30. Suitable means may be an electric or impact primer device 32.

Switch 10 may further include means for reinforcing the casing 16 above and below groove 22. Suitable means may be first and second band members 34, 36 extending circumferentially of casing 16, and being disposed on opposite sides of groove 22.

The disposition of propellant cartridge 26 and inserted body 24 defines a cavity volume 38 within casing 16 proximate the rupturing location defined by groove 22. Upon ignition, the oxidation-gas products of the ignitable material 30 expand into cavity 38 and cause casing 16 to rupture. The scoring pattern on surface 20 of casing 16 and the positioning of reinforcement bands 34, 36 control the gap width 40 at the rupture location on casing 16. The width of gap 40 determines the recovery voltage.

Figure 3A:
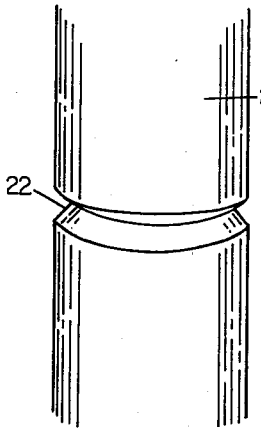
FIGS. 3A through 3D are illustrations of various casing scoring patterns which may be used in the switch of FIG. 1.
Figure 3B:
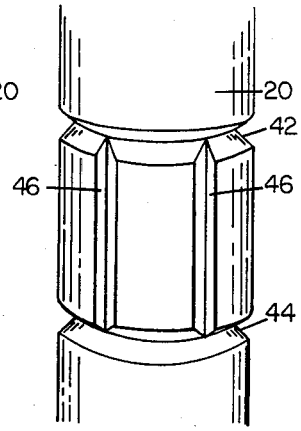
Figure 3C:
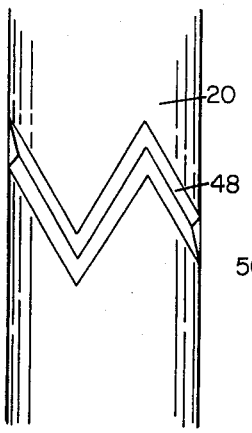
Figure 3D:
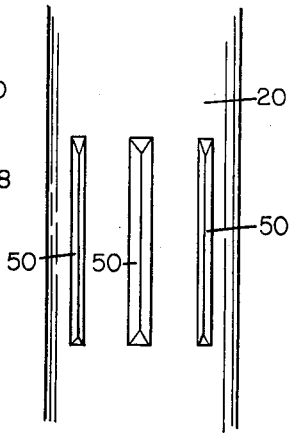

Referring now to FIGS. 3A through 3D, there are shown various alternate scoring patterns which can be utilized on outer surface 20 of casing 16. The illustration in FIG. 3A is of groove 22 which is shown in FIG. 1. However, in FIG. 3B there is shown a scoring pattern comprising first and second spaced-apart, circumferential grooves 42, 44 having a plurality of vertical grooves 46 extending therebetween. In FIG. 3C, there is shown a scoring pattern comprising a serpentine-circumferential groove 48. Finally, in FIG. 3D there is shown a scoring pattern comprising a plurality of vertical notch grooves 50. Each of these different scoring patterns will have different opening characteristics for a given propellant cartridge charge. Preferably, the grooves in each scoring pattern have acute angle bottoms.

Figure 4A:
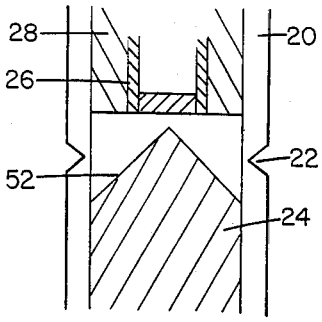
FIGS. 4A and 4B are section views of switches in accordance with the present invention showing alternate configurations for the spacer body carried internally of the switch casing.
Figure 4B:
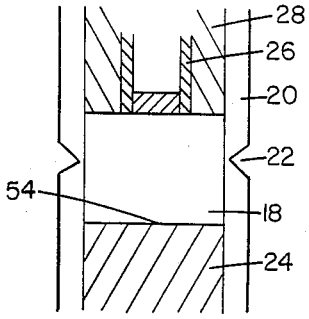

Referring now to FIGS. 4A and 4B, there is shown alternate configurations of the body 24 in switch 10. In FIG. 4A, the surface 52 opposing propellant cartridge 26 is of a conical configuration. In FIG. 4B, the surface 54 opposing propellant cartridge 26 is of a planar configuration extending substantially perpendicular to intercasing surface 18. The surface configuration is determinative of the gas pressure rise time within the cavity 38 of the switch.

Figure 5:
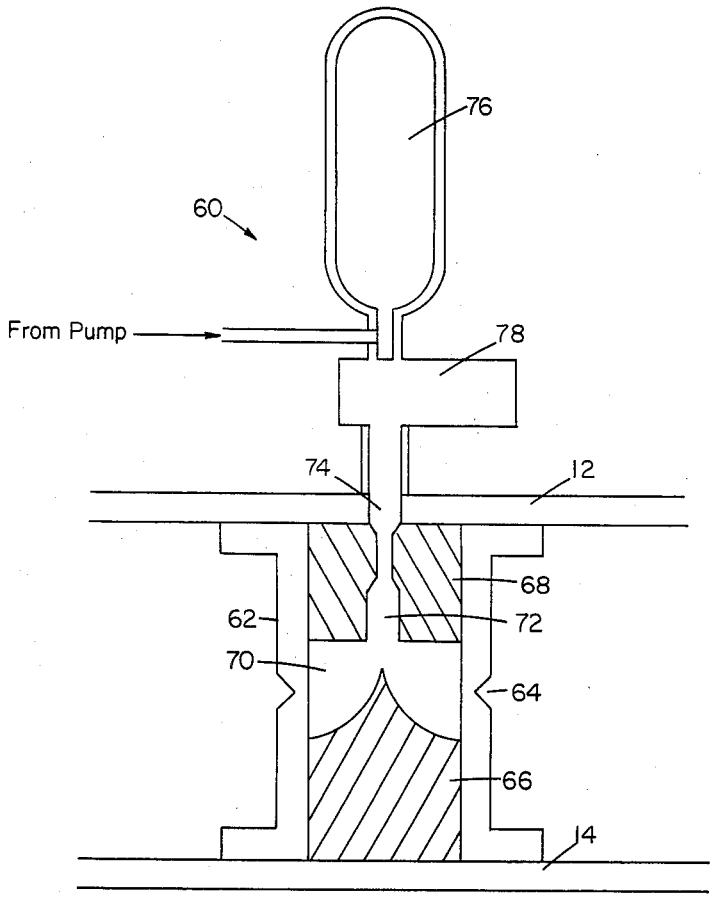
FIG. 5 is a second embodiment of an inductive store opening switch in accordance with the present invention.

In FIG. 5, there is an alternate embodiment of an inductive store opening switch 60 in accordance with the present invention. Switch 60 is similar to switch 10 in FIGS. 1 and 2 in that it includes a hollow casing 62 having the outer surface scored to establish a rupturing location thereon. In the embodiment shown in FIG. 5, the scoring comprises a single circumferential groove 64 intermediate the ends of casing 62. The casing and groove are identical to those shown in FIGS. 1 and 2. Additionally, the alternate scoring configurations shown in FIGS. 3A through 3D would also be applicable to casing 62.

A solid insert 66 is placed in casing 62 adjacent the rupturing location defined by groove 64. A second insert 68 is disposed within casing 62 opposite insert 66. Between inserts 66 and 68 a cavity 70 is defined.

Insert 68 includes a nozzle opening 72 therethrough. This nozzle opening is in registration with an opening 74 through B buss bar 12.

Through nozzle 72, pressurized fluid may be introduced into cavity 70 to cause casing 62 to rupture. A suitable source of pressurized fluid for introduction through nozzle 72 comprises a high pressure accumulator 76 having a volume of fluid contained therein and a fast-acting valve mechanism 78 for controlling the release of pressurized fluid from accumulator 76 to nozzle opening 72. The accumulator is, of course, supplied with pressurized fluid from a pump. Another means of releasing pressurized fluid from accumulator 76 to nozzle opening 72 would be a triggered rupture disc. The fluid may be a gas or a liquid. Also, as used herein, "high pressure" refers to a pressure on the order of 5,000 psi.

The foregoing description of the invention has been directed to particular preferred embodiments for purposes of explanation and illustration. It will be apparent, however, to those skilled in this art that many modifications and changes may be made in the inductive store opening switch structure without departing from the essence of the present invention. It is the intention that the following claims cover all equivalent modifications and variations as fall within the scope of the invention.

What is claimed is:

1. An inductive store opening switch for making and upon actuation breaking a connection between a pair of electrical conductors, comprising:

a hollow cartridge casing to be disposed between a pair of electrical conductors and in contact with both so as to establish a path for electrical current therebetween;

said casing having inner and outer surfaces, and having scoring on its outer surface to establish a rupturing location thereon;

a first body inserted within said casing and disposed adjacent the rupturing location on the casing;

a second body inserted within said casing and adjacent the rupturing location on the casing and opposite said first inserted body so as to define a cavity within the casing proximate the rupturing location;

a propellant cartridge disposed within said second body; and said cartridge carrying an ignitable material, for producing expanding oxidation-gas products in the cavity so as to rupture the casing, and means for igniting said material.

2. Opening switch apparatus for breaking a connection between a pair of electrical conductors, comprising:

a casing to be disposed between a pair of electrical conductors and in contact with both so as to establish a path for electrical current therebetween;

said casing having inner and outer surfaces, and having scoring on its outer surface to establish a rupturing location thereon;

a first body inserted within said casing and disposed adjacent the rupturing location on the casing; and a second body inserted within said casing adjacent the rupturing location on the casing and opposite said first inserted body so as to define a cavity within said casing proximate the rupturing location;

said second inserted body including a fluid jet nozzle opening to the cavity; and a source of pressurized fluid in communication with the opening in the second body for establishing fluid pressure within the cavity in the casing sufficient to produce rupturing of the casing.

3. An inductive store opening switch for breaking a connection between a pair of electrical conductors, comprising:

a casing to be disposed between a pair of electrical conductors so as to establish a path for electrical current therebetween;

said casing being scored on its outer surface to establish a rupturing location thereon;

a first body inserted within said casing and disposed adjacent the rupturing location on the casing;

a second body inserted within said casing adjacent the rupturing location on the casing and opposite said first inserted body so as to define a cavity within the casing proximate the rupturing location; and means for establishing fluid pressure within the cavity in the casing sufficient to produce rupturing.

4. The switch of claim 3 wherein said scoring on the casing outer surface comprises a single circumferential groove.

5. The switch of claim 3 wherein said scoring on the casing outer surface comprises first and second spacedapart circumferential grooves and a plurality of grooves extending between said first and second circumferential grooves.

6. The switch of claim 3 wherein said scoring on the casing outer surface comprises a plurality of adjacent longitudinal grooves.

7. The switch of claim 3 wherein said scoring on the casing outer surface comprises a serpentine, circumferential groove.

8. An inductive store opening switch for breaking a connection between a pair of electrical conductors, comprising:

a casing to be disposed between a pair of electrical conductors so as to establish a path for electrical current therebetween;

said casing being scored on its outer surface to establish a rupturing location thereon;

a body inserted within said casing and disposed adjacent the rupturing location on the casing;

means for establishing fluid pressure within the casing sufficient to produce rupturing; and said body having a planer surface exposed to the fluid pressure established within the casing.

9. An inductive store opening switch for breaking a connection between a pair of electrical conductors, comprising:

a casing to be disposed between a pair of electrical conductors so as to establish a path for electrical current therebetween;

said casing being scored on its outer surface to establish a rupturing location thereon;

a body inserted within said casing and disposed adjacent the rupturing location on the casing;

means for establishing fluid pressure within the casing sufficient to product rupturing; and said body having a conical surface exposed to the fluid pressure established within the casing.

10. An inductive store opening switch for breaking a connection between a pair of electrical conductors, comprising:

a casing to be disposed between a pair of electrical conductors so as to establish a path for electrical current therebetween;

said casing being scored on its outer surface to establish a rupturing location thereon;

means for establishing fluid pressure within the casing sufficient to produce rupturing; and means for reinforcing said casing adjacent the scoring to control the extent of rupturing of the casing.

11. The switch of claim 10 wherein said reinforcing means includes first and second band members extending circumferentially of said casing, said band members being disposed on opposite sides of the scoring.

* * * * *

UNITED STATES PATENT AND TRADEMARK OFFICE

CERTIFICATE OF CORRECTION

PATENT NO. : 4,571,468

DATED : February 18, 1986

INVENTOR(S) : William F. Weldon

It is certified that error appears in the above-identified patent and that said Letters Patent is hereby corrected as shown below:

Column 1, line 45, delete "oxidationgas" and insert --oxidation-gas--.

Column 5, lines 10-11, delete "spacedapart" and insert --spaced-apart--.

Column 1, line 41, delete "in as desired" and insert --in a desired--.

Column 3, lines 33-34, delete "intercasing" and insert --inner casing--; Line 56, delete "through B buss" and insert --through buss--.

Column 6, line 14, delete "product" and insert --produce--.

Signed and Sealed this

*Fifteenth* Day of *July 1986*

[SEAL]

*Attest:*

DONALD J. QUIGG

*Attesting Officer*

*Commissioner of Patents and Trademarks*